US006116654A

United States Patent [19]

Grootveld

[11] Patent Number: 6,116,654

[45] Date of Patent: Sep. 12, 2000

[54] REGISTRATION FORM

[75] Inventor: Jan Arie Frederik Grootveld, Amsterdam, Netherlands

[73] Assignee: Good Sports BV, Amsterdam, Netherlands

[21] Appl. No.: 08/981,533

[22] PCT Filed: Sep. 19, 1996

[86] PCT No.: PCT/NL96/00222

§ 371 Date: Dec. 5, 1997

§ 102(e) Date: Dec. 5, 1997

[87] PCT Pub. No.: WO96/39306

PCT Pub. Date: Dec. 12, 1996

[30] Foreign Application Priority Data

Jun. 6, 1995 [NL] Netherlands ..... 1000496

[51] Int. Cl.[7] ..... B42D 15/00

[52] U.S. Cl. ..... 283/75; 283/77

[58] Field of Search ..... 283/74, 75, 77, 283/72, 81, 101, 105, 109

[56] References Cited

U.S. PATENT DOCUMENTS

| | | | |
|---|---|---|---|
| 4,313,984 | 2/1982 | Moraw et al. | 283/77 |
| 4,663,518 | 5/1987 | Borror | 283/77 X |
| 4,773,677 | 9/1988 | Plasse | 283/77 |
| 5,543,010 | 8/1996 | Keng | 283/77 X |

*Primary Examiner*—Willmon Fridie, Jr.
*Attorney, Agent, or Firm*—St. Onge Steward Johnston & Reens LLC

[57] ABSTRACT

The invention relates to a registration form (1) for the registration of one or more particulars of a person or an object and of an identification means of that person or object, and for coupling the particulars and the identification mark to a registration means, to the registration mark. The form (1) comprises, at least for a part, an interacting upper part and under part which are detachable and reattachable to each other and between which upper part and under part the identification means can be visibly incorporated.

7 Claims, 1 Drawing Sheet

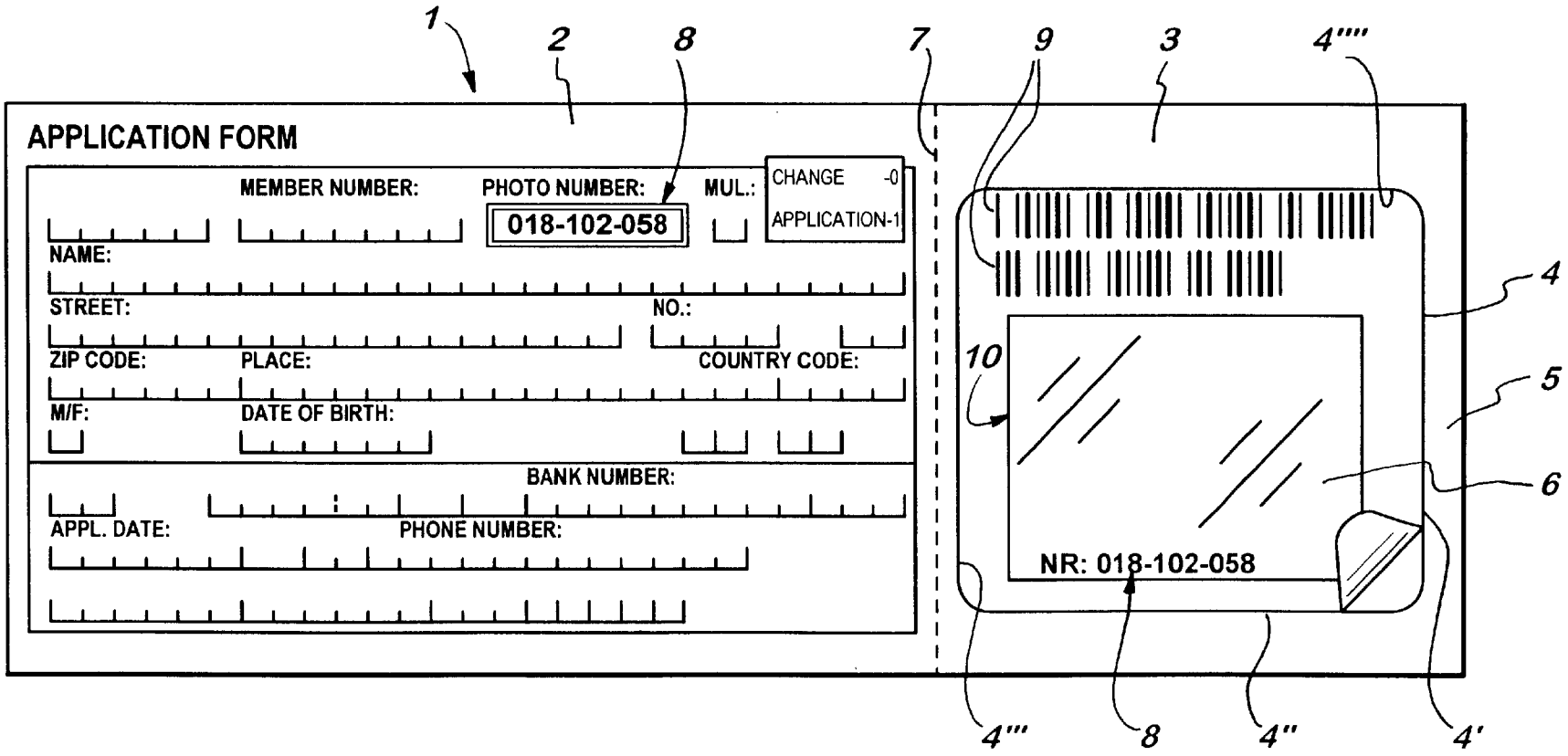
APPLICATION FORM
MEMBER NUMBER:
PHOTO NUMBER:
018-102-058
MUL.:
CHANGE -0
APPLICATION-1
NAME:
STREET:
NO.:
ZIP CODE:
PLACE:
COUNTRY CODE:
M/F:
DATE OF BIRTH:
BANK NUMBER:
APPL. DATE:
PHONE NUMBER:
NR: 018-102-058
1
2
3
4
4'
4''
4'''
4''''
5
6
7
8
9
10

REGISTRATION FORM

FIELD OF THE INVENTION

The invention relates to a registration form for the registration of one or more particulars of a person or an object and of an identification means of that person or that object, as well as for coupling the particulars and the identification means to a registration mark.

BACKGROUND OF THE INVENTION

From GB-A-2.272.667 an identity card is known which is laminated when ready, consisting of a form, wherein an identification means in the form of a photograph may be permanently incorporated between two form zones adhering to each other. The form also comprises a zone in which particulars are recorded that are to be processed by an administrative staff.

Such a registration form or application form or processing form is in practice used for feeding (digitalized) membership administrations such as of sports clubs. However, the form may also be used for the registration of paintings, jewellery and other objects. In such a case the registration form may serve to feed a data file which may or may not be digitalized. The existing registration forms have the disadvantage that they require various processing steps to be carried out by an administrative staff in order to couple the identification means undetachably to the particulars filled in on the form.

SUMMARY OF THE INVENTION

The inventions aims to simplify this, so that the administrative staff is required to carry out fewer processing steps. Another aim of the invention is to allow the user of the form to determine the quality of the identification means to be used himself. This is realized by means of the registration form according to the invention because it comprises, at least for a part, an interacting upper and under part which are detachable from and reattachable to each other, and between the upper and under part of which the identification means can be visibly incorporated. In this way the person filling in the registration form may include the identification means in the form without involving the administrative staff. Subsequently, the administrative staff is merely required to process the registration form, thus avoiding the risk of coupling the identification means to the particulars of the wrong person or object.

Preferably the upper part comprises a space or a transparent zone behind which the identification means can be affixed. Such a space or transparent zone defines a frame in which the identification means, for instance, a photograph of the person or the object, may be positioned exactly as desired. This could be useful in cases where the registration form is utilized for a personal administration when it also serves for the issue of registration certificates which carry a reproduction of such identification means. The frame then assists the positioned reproducibility of the identification means which is finally to be applied to the registration certificate. But also—in general—with other kinds of reproduction of the digitalized image based on the registration form, for instance, via a computer screen, the positioned reproducibility does not depend on operations by the administrative staff.

In a particular embodiment of the invention the form can be separated into a first field carrying the particulars of the person or object and a second field provided with the detachable and reattachable upper part and under part, wherein both the first field and the second field carries the registration mark. This has the advantage of allowing separate processing of the first field carrying the personal or object particulars and the second field which is provided with the identification means without yet causing any confusion regarding the coupling between the particulars and the identification means. Preferably the space is formed by removing a zone delimited by a perforation line from the upper part, which zone is provided with the registration mark. This part may be retained by the user. Should the coupling between the identification means and the registration mark become broken during the further processing of the registration form, then this coupling can be restored with the aid of the registration mark, which will then only be in the possession of the user, without the user having to supply a new identification means.

The registration mark is preferably machine-readable, such as a bar code. This allows simple automatic processing of the registration form. An upper and under part which is both releasable and resealable may be fabricated simply and effectively by providing them with a reversible adhesive coating.

It is also expedient to provide the zone which, for the benefit of the space, is to be removed from the upper part, with a reversible adhesive coating, so that it can simply be affixed after removal.

The invention will now be further elucidated with reference to the drawing showing a single FIGURE.

BRIEF DESCRIPTION OF THE DRAWING

FIG. 1 is plan view of a registration form in accordance with the invention.

The FIGURE shows a registration form 1, comprising a first field 2 for the registration of personal or other particulars, and also a second field 3 for the attachment of an identification means. The identification means, usually a photograph, can be attached to the second field 3 due to the fact that this field comprises, at least in part, an upper part 5 and a corresponding under part, wherein the upper part 5 can be detached from the under part underneath it along a line 4', 4", 4'". The upper part 5 and the under part stay attached to each other via a line 4"". The upper part 5 is further provided with a space 6 or a transparent zone 6 so that when after detaching the upper part 5 the identification means is affixed, and the upper part 5 is reattached to the under part, the identification means is visible through the frame formed by the space 6 or the transparent zone 6. The space 6 may be formed by removing a zone 6, as delimited by a perforated line 10, from the upper part 5 before carrying out the operations just described. This zone 6 is preferably also provided with the registration mark 8.

The registration form 1, comprising the first field 2 containing the particulars and the second field 3 containing the identification means, can be separated along a line 7. The fact that the first field 2 carries a registration mark by means of a number 8 and the second field 3 carries the same registration mark but in the form of a bar code 9, guarantees a coupling between the personal particulars and the identification means, which remains intact after separating the first field 2 and the second field 3 from the registration form 1.

If the registration mark takes the form of a bar code, completely automatic processing is possible. This has the advantage that a digital image of the identification means can be obtained automatically and reproducibly, while the particulars can be stored simultaneously with the digital registration of the registration mark 9. If, for some reason the registration mark 9 and the identification means become separated, they can simply be recoupled by input of the registration mark obtained from information contained in zone 6 detached from the upper part 5, which zone 6 is also provided with the registration mark 8.

By providing the upper part 5, respectively the part underneath with a reversible adhesive coating, the person making up the form can position the identification means within the frame formed by the space respectively the transparent zone 6 according to his own judgement. The advantage for the above-mentioned automatic processing is that the frame defines the space within which the identification means is located at any time, facilitating its digital registration directly off the registration form 1. The registration form according to the invention allows a continuous processing of personal c.q. object particulars and accompanying identification means.

What is claimed is:

1. A registration form for the registration of one or more particulars of a person or an object and of an identification means of that person or that object, and for coupling the particulars and the identifications means to a registration mark, comprising: a registration form having an upper part and a lower part underneath the upper part, said upper part (5) and under part being interacting by being detachable and reattachable to each other, one of said parts having a transparency so that the identification means can be visibly incorporated between the upper part (5) and said under part after being inserted between the parts.

2. A registration form according to claim 1, characterized in that the upper part (5) comprises a transparent zone (6) behind which the identification means can be affixed.

3. A registration form for the registration of one or more particulars of a person or an object and of an identification means of that person or that object, and for coupling the particulars and the identifications means to a registration mark, comprising: a registration form having an upper part and a lower part underneath the upper part, said upper part (5) and under part being interacting by being detachable and re-attachable to each other, one of said parts having a transparency so that the identification means can be visibly incorporated between the upper part (5) and said under part after being inserted between the parts, wherein the registration form has a first field (2) for carrying particulars of the person or object, and a second field (3) which is provided with the upper part (5) and the under part, and wherein both the first field and the second field carry a common registration mark (8,9).

4. A registration form for the registration of one or more particulars of a person or an object and of an identification means of that person or that object, and for coupling the particulars and the identifications means to a registration mark, comprising: a registration form having an upper part and a lower part underneath the upper part, said upper part (5) having a transparent zone behind which the identification means can be affixed, said upper part (50) and under part being interacting by being detachable and re-attachable to each other, one of said parts having a transparency so that the identification means can be visibly incorporated between the upper part (5) and said under part after being inserted between the parts; said transparent zone is bounded by a perforation line (10) formed in the upper part, and wherein the transparent zone is provided with the registration mark (8).

5. A registration form according to claim 1, characterized in that the registration mark (9) is in a machine-readable form.

6. A registration form according to claim 1, wherein one of said parts is provided with a reversible adhesive coating.

7. A registration form according to claim 4, characterized in that the the upper part is provided with a reversible adhesive coating.

* * * * *